US009168773B2

(12) United States Patent
Naka et al.

(10) Patent No.: US 9,168,773 B2
(45) Date of Patent: Oct. 27, 2015

(54) PRINTING METHOD AND PRINTING APPARATUS FOR PRINTING MAINTENANCE IMAGES ON A CONTINUOUS SHEET USING A DUPLEX PRINTER

(71) Applicant: CANON KABUSHIKI KAISHA, Tokyo (JP)

(72) Inventors: Akiteru Naka, Machida (JP); Kazunari Shishido, Yokohama (JP); Sho Nakamura, Yokohama (JP); Ruriko Mikami, Kawasaki (JP); Atsushi Hirahara, Kawasaki (JP); Takayoshi Noguchi, Tokyo (JP); Tatsuhiko Tomita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/567,279

(22) Filed: Dec. 11, 2014

(65) Prior Publication Data

US 2015/0091970 A1 Apr. 2, 2015

Related U.S. Application Data

(63) Continuation of application No. 13/366,115, filed on Feb. 3, 2012, now Pat. No. 8,936,407.

(30) Foreign Application Priority Data

Feb. 8, 2011 (JP) ..... 2011-025252

(51) Int. Cl.

| | |
|---|---|
| ***B41J 29/38*** | (2006.01) |
| ***B41J 29/393*** | (2006.01) |
| ***B41J 2/165*** | (2006.01) |
| ***B41J 3/60*** | (2006.01) |
| ***B41J 13/00*** | (2006.01) |

(52) U.S. Cl.

CPC ..... *B41J 29/393* (2013.01); *B41J 2/16526* (2013.01); *B41J 2/16579* (2013.01); *B41J 2/16585* (2013.01); *B41J 3/60* (2013.01); *B41J 13/0027* (2013.01)

(58) Field of Classification Search

CPC ..... B41J 2202/38; B41J 2029/3935

See application file for complete search history.

(56) References Cited

U.S. PATENT DOCUMENTS

2011/0211003 A1* 9/2011 Kusakabe ..... 347/14
2011/0293310 A1* 12/2011 Kurihara ..... 399/72

* cited by examiner

*Primary Examiner* — Daniel J Colilla
*Assistant Examiner* — Justin Olamit
(74) *Attorney, Agent, or Firm* — Canon USA Inc. IP Division

(57) ABSTRACT

A printing apparatus sequentially prints a plurality of images on a first surface of a sheet, and then sequentially prints a plurality of images on a second surface that is a back surface of the first surface. When a state of a printing unit is determined not to be normal when printing on the first surface, the printing apparatus executes processing for maintenance by using a sheet different from the sheet used for printing on the first surface.

12 Claims, 7 Drawing Sheets

PRINTING METHOD AND PRINTING APPARATUS FOR PRINTING MAINTENANCE IMAGES ON A CONTINUOUS SHEET USING A DUPLEX PRINTER

CROSS-REFERENCE TO RELATED APPLICATIONS

This application is a Continuation of U.S. application Ser. No. 13/366,115 filed Feb. 3, 2012 which claims priority from Japanese Patent Application No. 2011-025252 filed Feb. 8, 2011, all of which are hereby incorporated by reference herein in their entirety.

BACKGROUND OF THE INVENTION

1. Field of the Invention

The present invention relates to a technology for printing a plurality of images on a sheet by using a print head.

2. Description of the Related Art

Japanese Patent Application Laid-Open No. 2008-126530 discusses a printing apparatus that performs, by using a long continuous sheet wound in a roll shape, duplex printing on a front and a back (first surface and second surface) of the sheet by an ink jet method. The printing apparatus forms a mark on the first surface and, in the case of printing on the second surface, reads the mark to relatively align images formed on the front and the back.

Though not discussed in Japanese Patent Application Laid-Open No. 2008-126530, there is known a method for carrying out maintenance by preliminarily discharging ink to the sheet from the print head in a periodic or nonperiodic manner to reduce defective discharge of ink caused by nozzle clogging of the print head.

When maintenance of a printing unit is carried out in duplex printing as discussed in Japanese Patent Application Laid-Open No. 2008-126530, the following issues occur.

When defective discharge of ink occurs in the print head when printing of a plurality of images, maintenance must be carried out. An example is a case where an abnormality occurs in the printing unit when printing on the first surface in duplex printing, thus disabling normal printing of some images. In this case, when an area following a defective image of the first surface is used for maintenance, in subsequent printing on the second surface, no image can be printed on areas corresponding to the defective image and the area used for the maintenance. As a result, the areas corresponding to the defective image and the area used for the maintenance must be discarded, which increases wasteful consumption of sheets. The increase in wasteful sheet feeding causes a decrease of total printing throughput.

SUMMARY OF THE INVENTION

The present invention is directed to a printing method that can carry out maintenance, while reducing a wasteful consumption of sheets, when a state of a printing unit is not normal when printing.

According to an aspect of the present invention, a printing method includes printing a plurality of images on a sheet by a printing unit, and executing, when a state of the printing unit is determined not to be normal, processing for maintenance by using a sheet different from the printed sheet.

According to an exemplary embodiment of the present invention, maintenance can be carried out, while reducing a wasteful consumption of sheets, when the state of a printing unit is not normal when printing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A printing apparatus of an ink jet method according to a first exemplary embodiment of the present invention is described. The printing apparatus according to the first exemplary embodiment is a high-speed line printing apparatus that can perform both of simplex printing and duplex printing by using a continuous sheet wound in a roll shape. For example, the printing apparatus is suited to a field of printing a great volume of sheets at a printing laboratory.

Figure 1:
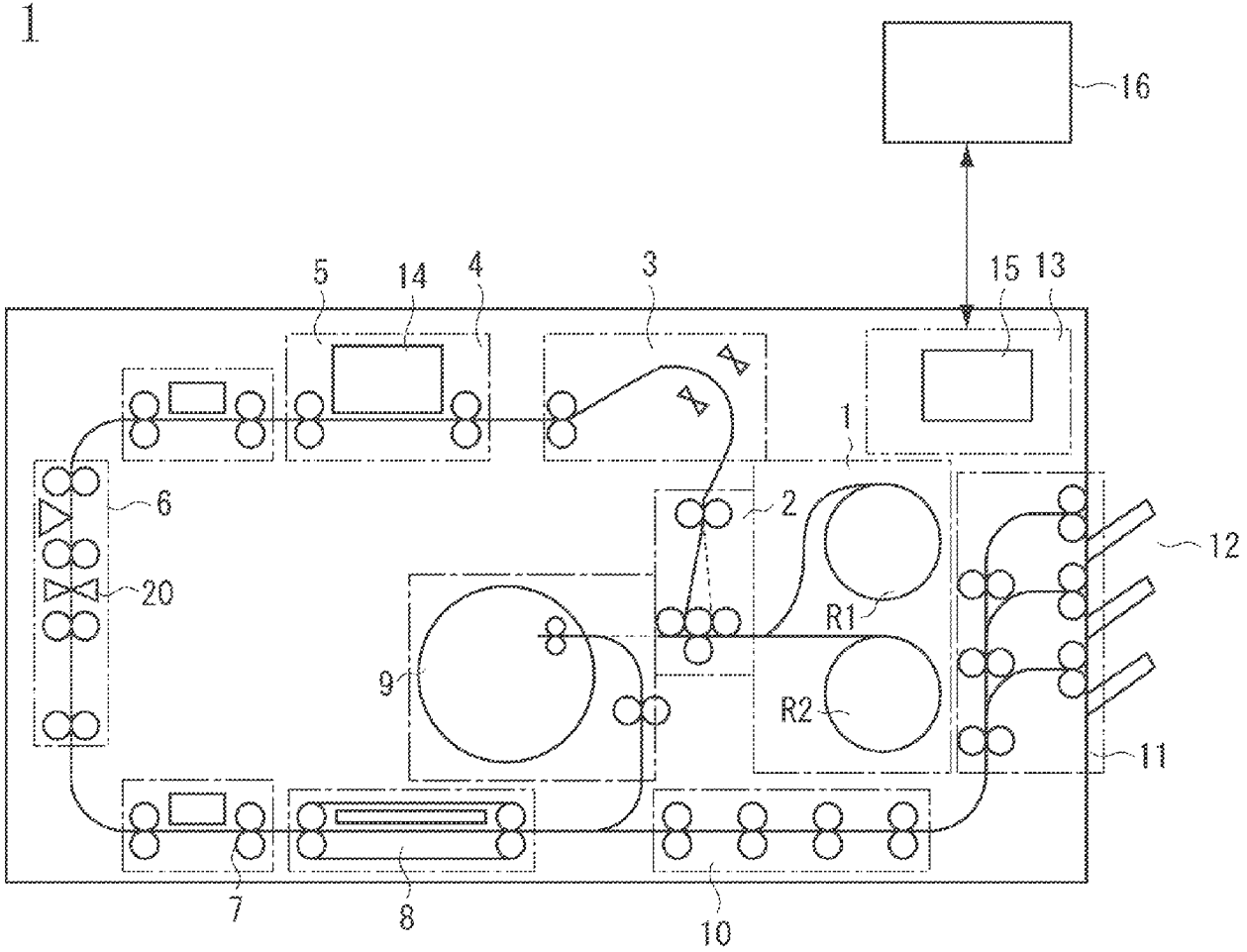
FIG. 1 schematically illustrates an internal configuration of a printing apparatus according to a first exemplary embodiment of the present invention.

FIG. 1 is a schematic sectional view illustrating an internal configuration of the printing apparatus. The printing apparatus according to the present exemplary embodiment can perform, by using a sheet wound in a roll shape, duplex printing on a first surface of the sheet and a second surface, which is a back surface of the first surface. The printing apparatus includes a sheet supply unit 1, a decurling unit 2, a skew correction unit 3, a printing unit 4, an inspection unit 5, a cutter unit 6, an information recording unit 7, a drying unit 8, a reversing unit 9, a discharge conveyance unit 10, a sorter unit 11, a sheet discharge unit 12, and a control unit 13. The sheet is conveyed on a sheet conveyance path indicated by an illustrated solid line by a conveyance mechanism including a roller pair and a belt, and processed at each unit. In an arbitrary position of the sheet conveyance path from sheet supplying to discharging, a side near the sheet supply unit 1 is referred to as "upstream", and its opposite side is referred to as "downstream".

The sheet supply unit 1 holds and supplies the continuous sheet wound in a roll shape. The sheet supply unit 1 can store two rolls R1 and R2, and is configured to selectively pull out and supply the sheet. The number of rolls to be stored is not limited to two. One or at least three can be stored. A sheet used is not necessarily limited to that wound in a roll shape. It is only required to be continuous. For example, a continuous sheet perforated at each unit length can be folded at each perforation to be stacked, and stored in the sheet supply unit 1.

The decurling unit 2 reduces curling (warpage) of a sheet supplied from the sheet supply unit 1. The decurling unit 2 reduces curling by using two pinch rollers for one driving roller, and bending and passing the sheet to give opposite warpage of the curling, thereby applying a decurling force.

The skew correction unit 3 corrects skewing (tilting relative to an original traveling direction) of the sheet having passed through the decurling unit 2. The skew correction unit 3 corrects the skewing of the sheet by pressing a sheet end of a side that becomes a reference to a guiding member.

The printing unit 4 is a sheet processing unit that forms an image on the conveyed sheet by executing printing on the sheet from above via a print head 14. The printing unit 4 includes a plurality of conveyance rollers for conveying the sheet. The print head 14 includes a line type print head where a nozzle array of an ink jet method is formed within a range covering a maximum width of a sheet expected to be used. In the print head 14, a plurality of print heads are arranged in parallel in a conveying direction. In the present exemplary embodiment, seven print heads are provided corresponding to seven colors of cyan (C), magenta (M), yellow (Y), light cyan (LC), light magenta (LM), gray (G), and black (K). The numbers of colors and print heads are not limited to seven. For the ink jet method, the print head 14 can employ one of a method using a heating element, a method using a piezoelectric element, a method using an electrostatic element, and a method using a micro electric mechanical system (MEMS) element. Each color ink is supplied from an ink tank through an ink tube to the print head 14.

The inspection unit 5 optically reads an inspection pattern or an image printed on the sheet at the printing unit 4 by a scanner, and determines whether the image has correctly been printed by inspecting a nozzle state of the print head, a sheet conveying state, or an image position. The scanner includes a charge-coupled device (CCD) image sensor or a complementary metal-oxide semiconductor (CMOS) image sensor.

The cutter unit 6 includes a cutter 20 for cutting the sheet after the printing to a predetermined length. The cutter 20 cuts the sheet in a blank area between images formed on the sheet and behind a last printed image.

The information recording unit 7 records print information (unique information) such as a serial number or a date in an unprinted area of the cut sheet. The recording is carried out by printing a character or a code based on the ink jet method or a thermal transfer method.

The drying unit 8 dries the applied ink within a short time by heating the sheet printed at the printing unit 4. In the drying unit 8, hot air is blown to the passing sheet from at least a bottom surface side to dry an ink applied surface. The drying method is not limited to the hot air blowing method. A method for applying an electromagnetic wave (ultraviolet ray or infrared ray) to the sheet surface can be employed.

The sheet conveyance path from the sheet supply unit 1 to the drying unit 8 is referred to as a first path. The first path has a U-turn shape between the printing unit 4 and the drying unit 8, and the cutter unit 6 is located in the midway of the U-turn shape.

The reversing unit 9 reverses a front and a back by temporarily taking up the front-surface printed continuous sheet in duplex printing. The reversing unit 9 is located in the midway of a path (loop path) (referred to as a second path) from the drying unit 8 through the decurling unit 2 to the printing unit 4 to supply the sheet having passed through the drying unit 8 to the printing unit 4 again. The reversing unit 9 includes a take-up rotor (drum) for taking up the sheet. The front-surface printed continuous sheet yet to be cut is temporarily taken up by the take-up rotor. After the taking-up, the take-up rotor reversely rotates to feed the taken-up sheet in reverse to the taking-up. The sheet is supplied to the decurling unit 2, and then sent to the printing unit 4. This sheet is reversed front and back, and hence the printing unit 4 can print an image on the back surface. A more specific operation of duplex printing is described below.

The discharge conveyance unit 10 conveys the sheet cut by the cutter unit 6 and dried by the drying unit 8, and transfers the sheet to the sorter unit 11. The discharge conveyance unit 10 is located in a path (referred to as a third path) different from the second path located in the reversing unit 9. To selectively guide the sheet conveyed on the first path to one of the second path and the third path, a path switching mechanism having a movable flapper is installed in a path branch position.

The sorter unit 11 and the sheet discharge unit 12 are located on a side of the sheet supply unit 1 and at a tail end of the third path. The sorter unit 11 sorts printed sheets by groups when necessary. The sorted sheets are discharged to the sheet discharge unit 12, which includes a plurality of trays. Thus, the third path is laid out to pass the sheet below the sheet supply unit 1 and discharge the sheet to a side opposite the printing unit 4 and the drying unit 8 across the sheet supply unit 1.

As described above, the units from the sheet supply unit 1 to the drying unit 8 are sequentially located on the first path. A portion after the drying unit 8 is branched into the second path and the third path, the reversing unit 9 is located in the midway of the second path, and a portion after the reversing unit 9 merges with the first path. The sheet discharge unit 12 is located at the tail end of the third path.

The control unit 13 controls each unit of the entire printing apparatus. The control unit 13 includes a central processing unit (CPU), a storage device, a controller that includes various control units, an external interface, and an operation unit 15 that a user operates to input/output data. An operation of the printing apparatus is controlled based on a command from the controller or a host apparatus 16 such as a host computer connected to the controller via the external interface.

Figure 2:
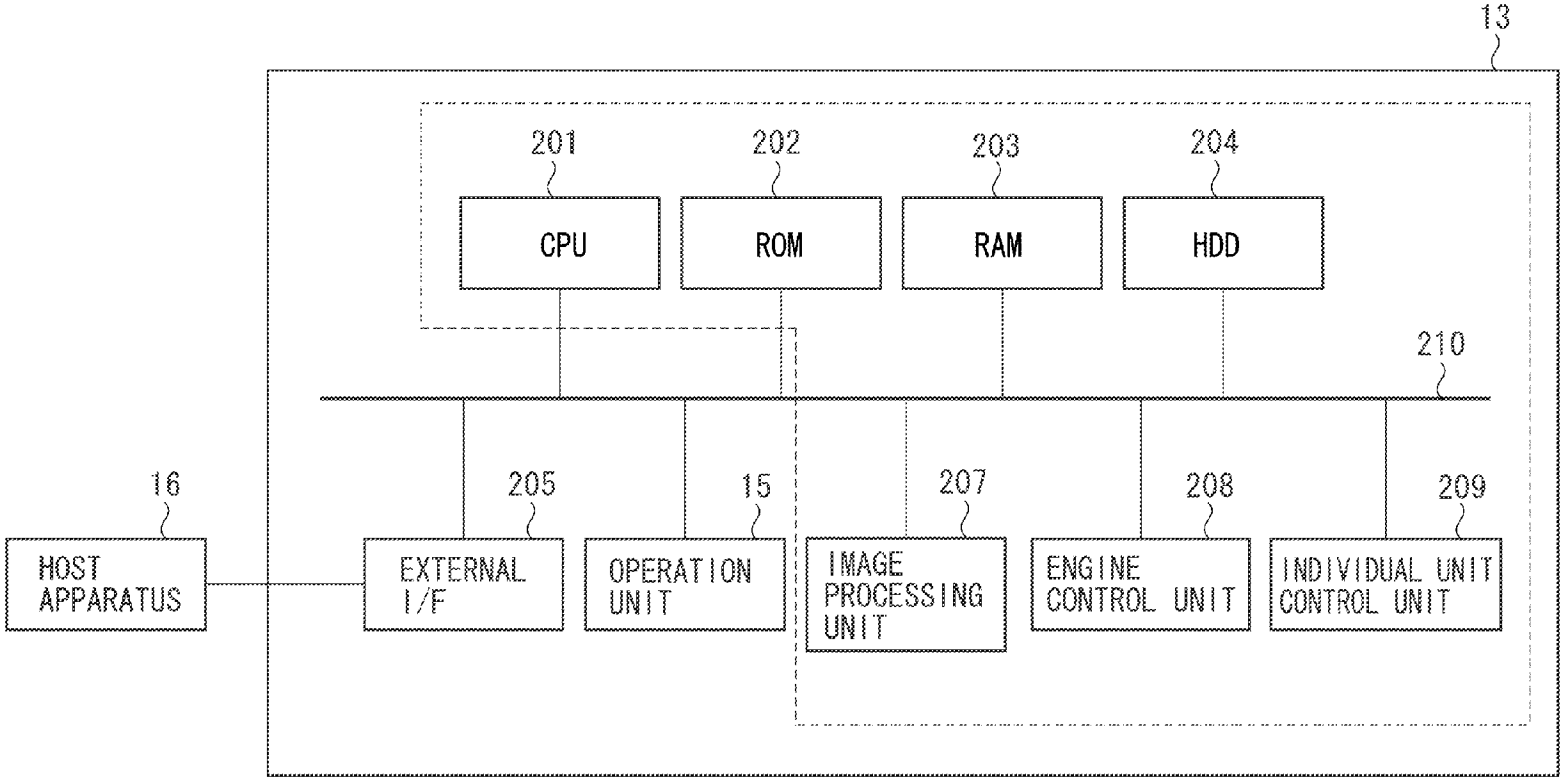
FIG. 2 is a block diagram illustrating a control unit according to the first exemplary embodiment.

FIG. 2 is a block diagram illustrating a configuration of the control unit 13. The controller (a range surrounded with broken line) of the control unit 13 includes a CPU 201, a read-only memory (ROM) 202, a random access memory (RAM) 203, a hard disk drive (HDD) 204, an image processing unit 207, an engine control unit 208, and an individual unit control unit 209. The CPU 201 controls operations of the units of the printing apparatus in an integrated manner. The ROM 202 stores a program executed by the CPU 201 or fixed data necessary for various operations of the printing apparatus. The RAM 203 is used as a work area for the CPU 201 or a temporary storage area of various received data, or stores various setting data. The HDD 204 can store the program executed by the CPU 201, print data, or setting information necessary for various operations of the printing apparatus, and such data can be read from the HDD 204. The operation unit 15 serving as an input/output interface with the user includes an input unit such as hard keys or a touch panel, and an output unit such as a display or an audio generator for presenting information.

A dedicated processing unit is disposed for a unit required of high-speed data processing. The image processing unit 207 executes image processing for print data processed at the printing apparatus. The image processing unit 207 converts a color space (e.g., YCbCr) of input image data into a standard RGB color space (e.g., sRGB). The image processing unit 207 carries out various image processes such as resolution conversion, image analysis, and image correction for the image data. Print data acquired by such image processing is stored in the RAM 203 or the HDD 204. The engine control unit 208 controls, based on a control command received from the CPU 201, driving of the print head 14 of the printing unit 4 according to the print data. The engine control unit 208 also controls a conveyance mechanism of each unit in the printing apparatus. The individual unit control unit 209 is a sub-controller that individually controls the sheet supply unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, and the sheet discharge unit 12. Based on a command from the CPU 201, the individual control unit 209 controls an operation of each unit. The external interface 205, which is an interface (I/F) for connecting the controller to the host apparatus 16, is a local I/F or a network I/F. These components are interconnected via a system bus 210.

The host apparatus 16 is a supply source of image data for causing the printing apparatus to perform printing. The host apparatus 16 can be a general-purpose or dedicated computer, or a dedicated image device such as an image capturing device, a digital camera, or a photostorage device that includes an image reader unit. When the host apparatus 16 is a computer, an operating system (OS), application software for generating image data, and a printer driver for the printing apparatus are installed in a storage device included in the computer. It is not essential to achieve all the processes by software. Some or all of the processes can be achieved by hardware.

Next, a basic operation during printing is described. Printing operations are different between a simplex printing mode and a duplex printing mode, and thus each is described.

In the simplex printing mode, the printing unit 4 prints images on a front surface (first surface) of a sheet supplied from the sheet supply unit 1 and processed at the decurling unit 2 and the skew correction unit 3. Images (unit images) of predetermined unit lengths in a predetermined direction are sequentially printed on the long continuous sheet to form a plurality of images in a row. A blank area is formed between a certain image and its next image, and the printing unit 4 records cut marks in such blank areas. The printed sheet is passed through the inspection unit 5 and, at the cutter unit 6, cut by unit images by the cutter 20 based on the cut marks detected by a cut mark sensor. When necessary, the information recording unit 7 records print information on back surfaces of the cut sheets. The cut sheets are conveyed one by one to the drying unit 8 to be dried. Then, the cut sheets are passed through the discharge conveyance unit 10, and sequentially discharged to the sheet discharge unit 12 of the sorter unit 11 to be stacked. A sheet left on the printing unit 4 side at last cutting of a unit image is returned to the sheet supply unit 1 to be taken up into a roll R1 or R2. Thus, in the simplex printing mode, the sheet is passed through the first path and the third path to be processed while not passed through the second path.

In duplex printing, a printing sequence is carried out on the back surface (second surface) after the front surface (first surface) printing sequence. In the first front surface printing sequence, operations of the units from the sheet supply unit 1 to the inspection unit 5 are similar to those in the simplex printing. Without being cut at the cutter unit 6, the sheet is conveyed still as the continuous sheet to the drying unit 8. After ink drying of the front surface at the drying unit 8, the sheet is guided not to the path (third path) of the discharge conveyance unit 10 side but to the path (second path) of the reversing unit 9 side. On the second path, the take-up rotor of the reversing unit 9, which rotates in a forward direction (anticlockwise in FIG. 1), takes up the sheet. When the scheduled front surface printing is all ended at the printing unit 4, the cutter unit 6 cuts a rear end of a printed area of the continuous sheet. Using a cutting position as a reference, the continuous sheet on the downstream side (printed side) in a conveying direction is passed through the drying unit 8, and all taken up until the sheet rear end (cutting position) at the reversing unit 9. Simultaneously with the taking-up, the continuous sheet left on the upstream side (printing unit 4 side) of the cutting position in the conveying direction is rewound by the sheet supply unit 1 not to leave a sheet leading end (cutting position) at the decurling unit 2, and then taken up into a roll R1 or R2. This taking-up enables prevention of collision with a sheet supplied again in the back surface printing sequence described below.

After the front surface printing sequence, the processing switches to the back surface printing sequence. The take-up rotor of the reversing unit 9 rotates in a direction (clockwise in FIG. 1) opposite that during the taking-up. A rear end of the taken-up sheet (sheet rear end during the taking-up becomes a sheet leading end during feeding) is fed along an illustrated broken-line path to the decurling unit 2. The decurling unit 2 corrects curling given by the take-up rotor. In other words, the decurling unit 2 is located between the sheet supply unit 1 and the printing unit 4 on the first path and between the reversing unit 9 and the printing unit 4 on the second path to commonly work as a unit to eliminate curling on both paths. The sheet reversed front and back is passed through the skew correction unit 3 to the printing unit 4, and unit images and cut marks are printed on the back surface of the sheet. The printed sheet is passed through the inspection unit 5, and then cut by preset predetermined unit lengths at the cutter unit 6. The images are printed on both surfaces of the cut sheet, and hence no recording occurs at the information recording unit 7. The cut sheets are conveyed one by one to the drying unit 8, passed through the discharge conveyance unit 10, and sequentially discharged to the sheet discharge unit 12 of the sorter unit 11 to be stacked. Thus, in the duplex printing mode, the sheet is sequentially passed through the first path, the second path, and the third path to be processed.

Next, a case where the state of the printing unit 4 is not normal during printing of a plurality of images in the duplex printing mode, for example, processing when a failure occurs at the print head 14, is described. The failure of the print head means, for example, a state where nozzle clogging causes defective discharge of ink. The defective discharge of ink provides adverse effects such as streak unevenness on an image due to discharging of no ink from a defective nozzle or a color change due to a reduced ink discharge amount from the defective nozzle. The state of the printing unit 4 is not limited to the state of the print head. It can be a state of another member to be maintained in the printing unit 4, such as that of the sheet conveyance mechanism.

Figure 3:
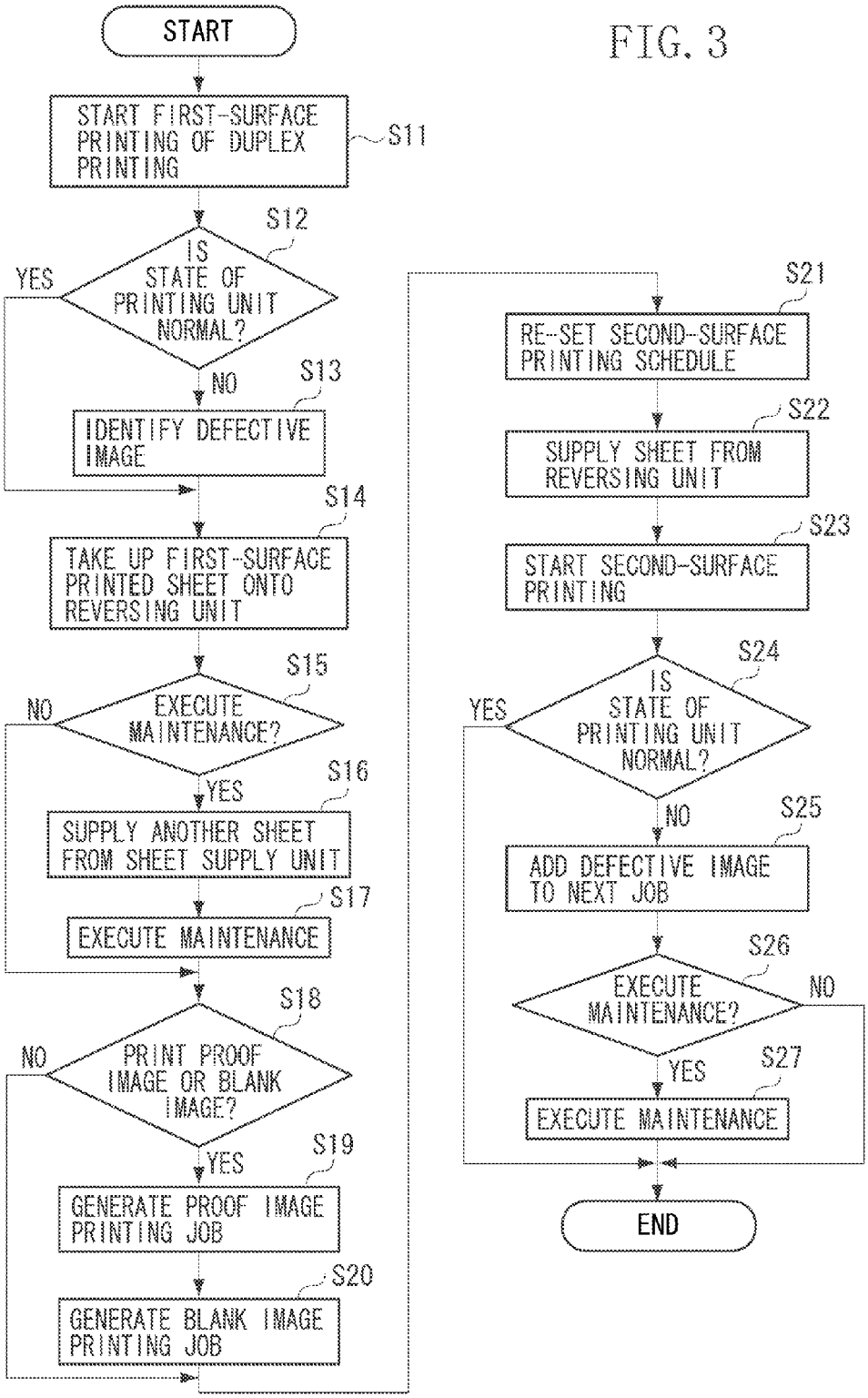
FIG. 3 is a flowchart illustrating a processing sequence when defective discharge of ink occurs in a printing unit during printing in a duplex printing mode.

FIG. 3 is a flowchart illustrating a processing sequence according to the first exemplary embodiment. An order of images to be printed on the first surface and the second surface of the sheet in the duplex printing mode is preset as a printing schedule. In step S11, the control unit 13 starts printing on the first surface according the printing schedule.

In step S12, the control unit 13 determines whether a state of the printing unit 4 is normal during printing on the first surface. For defective discharge of ink of the print head, the control unit 13 forms an inspection pattern between images sequentially printed on the first surface of the sheet by using all the nozzles of the print head, and reads the formed inspection pattern to determine when ink has been discharged to a correct position. The control unit 13 determines that the state of the printing unit 4 is normal when all the inks are at correct positions (YES in step S12), and not normal when the inks are not at the correct positions (NO in step S12). The processing proceeds to step S14 when YES, and to step S13 when NO.

In step S13, the control unit 13 identifies and stores images estimated to be defective in printing after the state of the printing unit 4 has become abnormal. When determining that the state of the printing unit 4 is not normal during the printing on the first surface, the control unit 13 changes the printing schedule to cancel scheduled printing of subsequent images on the first surface.

In step S14, the control unit 13 takes up the first-surface printed sheet at the reversing unit 9. When a printing failure occurs, the sheet including the defective image is taken up at the reversing unit 9. When the control unit 13 changes the printing schedule in step S13, a length of the sheet taken up at the reversing unit 9 is shorter than planned. As described above, after printing of a last image on the first surface, the sheet is cut behind the last image, and the sheet left on the upstream side is returned to the sheet supply unit 1. Thus, after the processing in step S14, there is no sheet below the print head.

In step S15, the control unit 13 determines whether to execute maintenance. The control unit 13 determines to execute maintenance (YES in step S15) when it determines that the state of the printing head is not normal (NO in step S12). The control unit 13 determines not to execute maintenance (NO in step S15) when it determines that the state of the printing head is normal (YES in step S12). However, when the preset printing schedule includes scheduled maintenance on the first surface, the control unit 13 determines to execute maintenance (YES in step 15) even if no failure is detected at the printing unit 4. When there is an operation mode set not to execute maintenance even if a failure occurs at the printing unit 4, the control unit 13 always determines not to execute maintenance (NO in step S15). When determination is YES in step S15, the processing proceeds to step S16. When NO, the processing proceeds to step S18.

In step S16, the control unit 13 supplies a sheet again from the sheet supply unit 1 to the printing unit 4. In this case, the control unit 13 can supply the sheet again from the same rewound roll or a new sheet from another roll. Alternatively, the control unit 13 can employ a form where after cutting of the sheet at the last printing on the first surface, a part of the sheet on the upstream side is left in the path without being completely returned to the sheet supply unit 1, and the same sheet is directly supplied. In other words, any form can be employed as long as a sheet different from the first-surface printed sheet is used for maintenance of the printing unit 4.

In step S17, the control unit 13 executes processing for maintenance of the printing unit 4. The control unit 13 prints an inspection image for maintenance on the supplied sheet by the print head. The control unit 13 reads the printed inspection image by the scanner of the inspection unit 5 to analyze it. Based on a result of the analysis, the control unit 13 finely adjusts control for an ink discharge amount, discharge timing, or a sheet conveying speed. An example of the maintenance is color shading correction. In the color shading correction, for example, the control unit 13 prints an inspection image including several tens of thousands of color patterns for color adjustment of a color image, and reads the inspection image by the scanner of the inspection unit to inspect whether the image is output with a correct color. When color misregistration is detected, the control unit 13 eliminates the color misregistration by adjusting an ink application amount of each color. Another example of the maintenance is inspection of defective discharge of ink of the print head. To inspect defective discharge of ink, the control unit 13 reads the printed inspection image by the scanner to inspect whether there is any defective nozzle discharge. When there is a defective nozzle discharge, the control unit 13 carries out head maintenance by preliminarily discharging ink to the sheet from the print head.

In step S18, the control unit 13 determines whether to print a proof image or a blank image. The proof image is an image pattern for proof inspection carried out, to determine whether image data has correctly been printed on the sheet, to print a specified image by way of trial and automatically or visually inspect the image by the user. The processing proceeds to step S19 when the control unit 13 prints the proof image or the blank image (YES in step S18), and to step S21 when not (NO in step S18).

In step S19, the control unit 13 generates a job (proof printing job) for printing the proof image on the second surface of the sheet. The proof printing job is generated when the following condition is satisfied. The condition is that the proof image can be printed by using the sheet back surface of an area where a print head failure causes a defective image on the first surface. Specifically, when there is a sufficient printing area to execute proof printing, and the first-surface printed sheet and the sheet for proof printing are similar in type or nature, the control unit 13 determines that proof printing can be carried out.

In step S20, the control unit 13 generates a job for printing a blank image on the second surface of the sheet. In reality, printing of the blank image is blank feeding of the sheet without applying any ink. The proof image is allocated to the area of the defective image, while the blank image is allocated to the remaining area. No blank image is allocated when the defective image areas are all filled with the proof images.

In step S21, the control unit 13 re-sets a printing schedule on the second surface. When determining that the state of the printing unit 4 is normal (YES in step S12), the control unit 13 sets the preset printing schedule without any change. When determining that the state of the printing unit 4 is not normal (NO in step S12), the control unit 13 cancels the scheduled printing of some images. To print the proof image or the blank image on the second surface corresponding to the defective image of the first surface, the control unit 13 inserts the job generated in step S19 or step S20. The control unit 13 directly uses a job of the second surface image corresponding to a nondefective image of the first surface without any change. The processing in step S21 is described in detail below.

In step S22, the control unit 13 supplies the first-surface printed sheet temporarily stored in the reversing unit 9 to the printing unit 4. In step S23, the control unit 13 starts printing on the second surface of the supplied sheet according to the printing schedule set in step S21.

In step S24, the control unit 13 determines whether the state of the printing unit 4 is normal. A determination method is similar to that of step S12. When YES in step S24, the processing sequence is ended after completion of the printing on the second surface. When NO in step S24, the processing proceeds to step S25.

In step S25, the control unit 13 identifies an image of the second surface estimated to be defective in printing after the state of the printing unit 4 has become abnormal. The control unit 13 then adds the identified image of the second surface and a corresponding image of the first surface of the back surface to a next print job so that they can be printed in a next duplex printing sequence. When a failure is detected at the printing unit 4 during the printing on the second surface, the control unit 13 can change the printing schedule to cancel the scheduled printing of subsequent images on the second surface. When the state of the printing unit 4 is determined not to be normal during the printing on the second surface (NO in step S24), the control unit 13 sets execution of maintenance before a start of next duplex printing by using a sheet to be supplied next. Alternatively, the control unit 13 can execute maintenance by using a subsequent area of the second surface.

In step S26, the control unit 13 determines whether to execute maintenance for the printing unit 4. When YES in step S26, then in step S27, the control unit 13 executes processing for the maintenance. When NO in step S26, the processing sequence is ended. When maintenance is set to be executed before the start of next duplex printing, the processing ends without executing any maintenance. Processing contents of step S27 are similar to those of steps S15 and S17. The processing sequence is ended after the series of processes has ended.

Figures 4A, 4B, 4C:
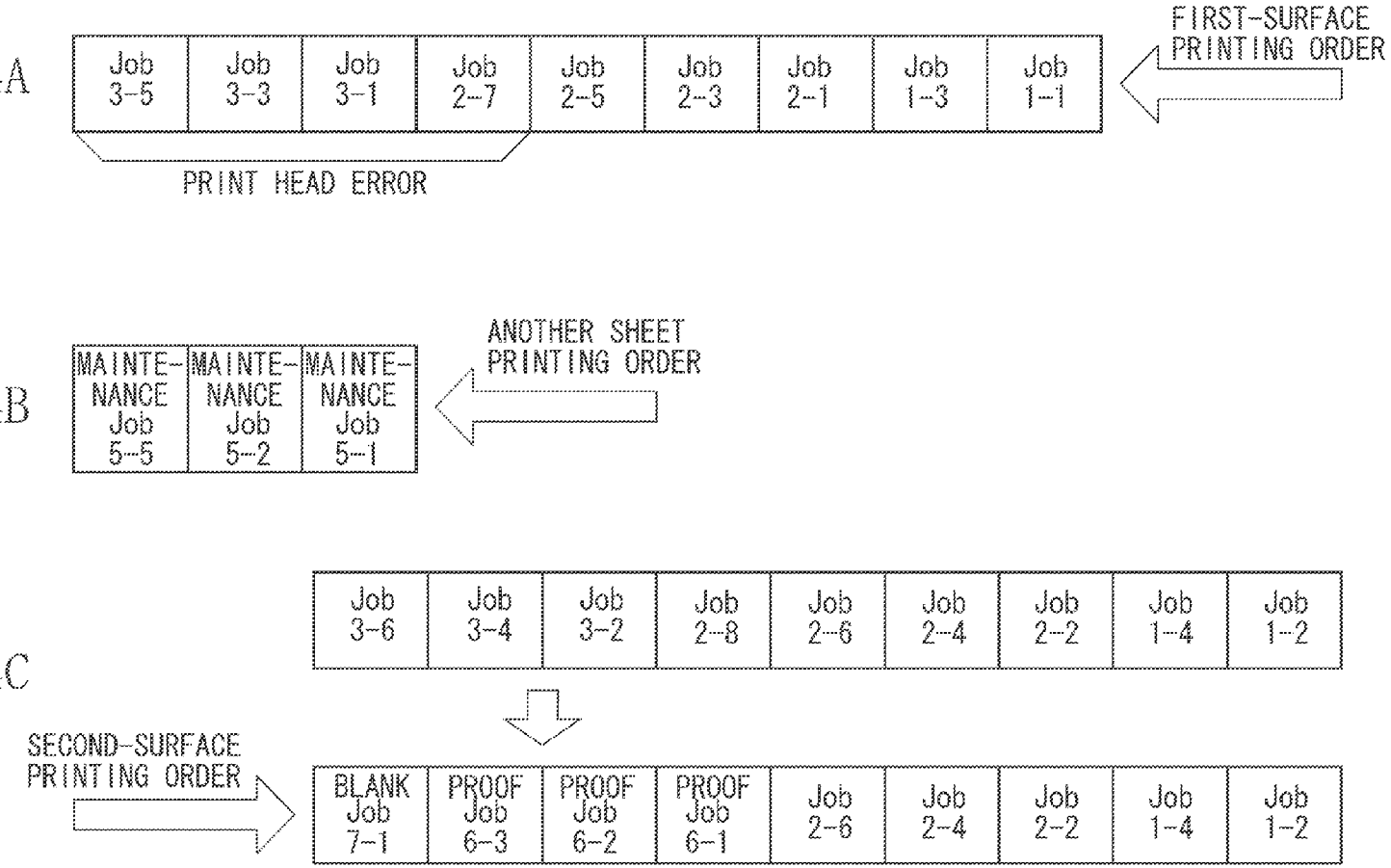
FIGS. 4A, 4B, and 4C are explanatory conceptual diagrams illustrating printing schedule re-setting according to the first exemplary embodiment.

FIGS. 4A, 4B, and 4C are explanatory conceptual diagrams illustrating printing schedule re-setting in step S21. FIG. 4A is a conceptual diagram of a first surface printing schedule illustrating a printing order of a plurality of images during first surface printing. Images of odd-number pages are printed in order on the first surface of the sheet. One print job includes a printing command of a plurality of continuous pages. In this example, a print job Job1 includes images of four pages Job1-1, Job1-2, Job1-3, and Job1-4. The images of the odd-number pages are printed in order on the first surface of the sheet. Hence, for the job Job1, two pages Job1-1 and Job1-3 are included in the first surface printing schedule. A job Job2 following the job Job1 includes eight pages Job2-1 to Job2-8, and four odd-number pages Job2-1, Job2-3, Job2-5, and Job2-7 are included in the first surface. A job Job3 following the job Job2 includes six pages Job3-1 to Job3-6, and three odd-number pages Job3-1, Job3-3, and Job3-5 are included in the first surface. In the first surface printing, the images are printed in an arrow order of pages Job1-1 to Job3-5 illustrated in FIG. 4A. After printing of the last image of page Job3-5, the sheet is cut behind the last image, and all the printed pages are taken up at the reversing unit 9.

In this example, the printing unit 4 is in a normal state from page Job1-1 to page Job2-5, so that normal images are printed. A failure occurs at the printing unit 4 for the image of page Job2-7, and accordingly the images from page Job2-7 to page Job3-5 are not normal.

FIG. 4B illustrates a printing order of inspection images in step S17. In this example, there are three inspection images of maintenance Job5-1 to Job5-3. These inspection images are printed on another sheet in an arrow order to be inspected.

FIG. 4C is a conceptual diagram of a second surface printing schedule illustrating a printing order of a plurality of images during second surface printing. An upper row illustrated in FIG. 4C is a preset printing schedule. Images of even-number pages are printed in the second surface in order. Even-number pages Job1-2 to Job3-6 included in three jobs Job1 to Job3 are arranged in order.

A lower row illustrated in FIG. 4C is a printing schedule as a result of the re-setting in step S21. pages Job1-2 to Job2-6 of a back surface side corresponding to the five pages Job1-1 to Job2-5 normally printed on the first surface are printed as scheduled. On the other hand, pages Job2-8 to Job3-6 of the back surface side corresponding to the four pages Job2-7 to Job3-5 not normally printed on the first surface due to an abnormality of the printing unit 4 are canceled. These pages are canceled because since the image on the first surface is defective, a final result of duplex printing becomes defective even when a normal image is printed on the second surface.

The canceled position is replaced by a proof image or a blank image. In this example, the positions are replaced by three pages Job6-1 to Job6-3 for printing proof images and one page Job7-1 for printing a blank image. Even when there is a defective image on the sheet back surface (second surface), the proof images have no problems in proof. These images are printed on another sheet in an arrow order to be inspected.

Thus, the use of the back surface side of the area, to be discarded due to the defective first surface, for proof image printing enables a reduction of wasteful sheet consumption. Wasteful sheet feeding is reduced, and hence a decrease of total printing throughput can be reduced. The back surface side of the area to be discarded due to the defective first surface is fed, with blank, as a blank image. Thus, a wasteful ink consumption can be reduced.

According to the first exemplary embodiment, when determining that the printing unit is not normal during the printing on the first surface in the duplex printing mode, the control unit executes processing (inspection image printing or preliminary ink discharge to sheet) for maintenance of the printing unit by using a sheet different from the first-surface printed sheet. In other words, when determining that the printing unit is not normal during the printing on the first surface in the duplex printing mode, the control unit executes processing for maintenance of the printing unit before the start of printing a plurality of images on the second surface. According to the first exemplary embodiment, when determining that the printing unit is not normal during the printing on the first surface in the duplex printing mode, the control unit executes processing (proof image printing) for maintenance of the printing unit by using the second surface of the first-surface printed sheet. On the second surface, the control unit executes processing for maintenance by using a back face of an image not normal among the plurality of images printed on the first surface. Thus, maintenance of the printing unit can be carried out while reducing a wasteful sheet consumption. Wasteful sheet feeding is limited. Thus, a decrease of total printing throughput can be reduced.

Figure 5:
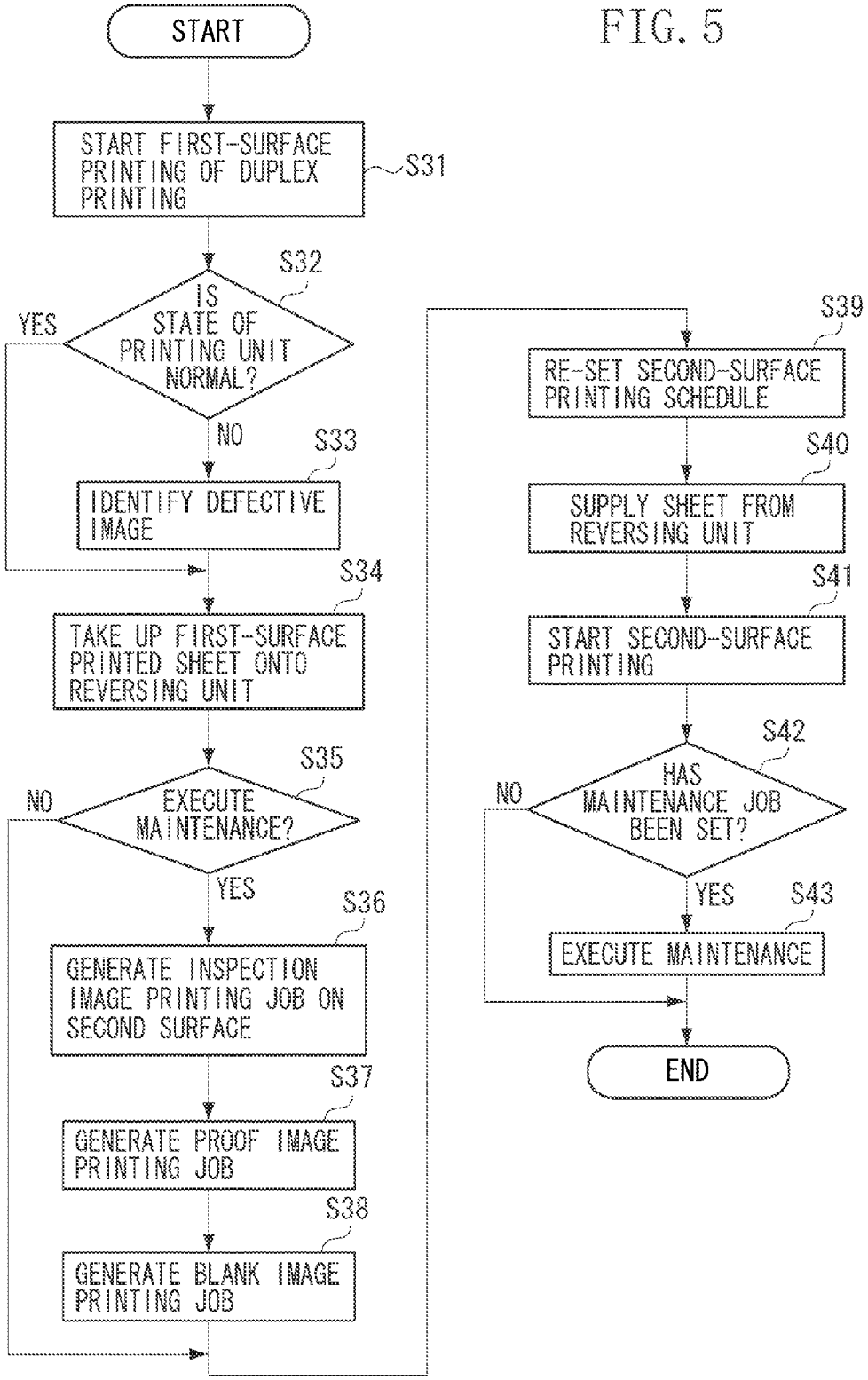
FIG. 5 is a flowchart illustrating a processing sequence according to a second exemplary embodiment of the present invention.

According to a second exemplary embodiment of the present invention, the control unit executes processing for maintenance by using a second surface of a first-surface printed sheet. FIG. 5 is a flowchart illustrating a processing sequence according to the second exemplary embodiment.

An order of printing images on the first surface and the second surface in the duplex printing mode is preset as a printing schedule. Processing in steps S31 to S34 is similar to that in steps S11 to S14 illustrated in FIG. 3.

In step S35, the control unit 13 determines whether to execute maintenance. The control unit 13 determines to execute maintenance (YES in step S35) when it determines that a state of the printing head is not normal (NO in step S32). The control unit 13 determines not to execute maintenance (NO in step S35) when it determines that the state of the printing head is normal (YES in step S32). When determination is YES in step S35, the processing proceeds to step S36. When NO, the processing proceeds to step S39.

In step S36, the control unit 13 generates a job for printing an inspection image for maintenance on the second surface of the sheet. According to the first exemplary embodiment, the inspection image is printed on a sheet different from the first-surface printed sheet. Unlike the first exemplary embodiment, according to the second exemplary embodiment, the inspection image is printed on the second surface of the same sheet.

In step S37, the control unit 13 generates a job for printing a proof image on the second surface of the sheet. In step S38, the control unit 13 generates a job for printing a blank image on the second surface of the sheet. The proof image or the blank image is allocated to a remaining area that is left after the inspection image is allocated to a defective image area of the first surface. None of a proof image and a blank image may be allocated.

In step S39, the control unit 13 re-sets a printing schedule on the second surface. When determining that the state of the printing unit 4 is normal (YES in step S32), the control unit 13 sets the preset printing schedule without any change. When determining that the state of the printing unit 4 is not normal (NO in step S32), the control unit 13 cancels printing of some images. To print the inspection image, the proof image or the blank image on the second surface corresponding to the defective image of the first surface, the control unit 13 inserts the jobs generated in steps S36 to S38.

In step S40, the control unit 13 supplies the first-surface printed sheet temporarily stored in the reversing unit 9 to the printing unit 4. In step S41, the control unit 13 starts printing on the second surface of the supplied sheet according to the printing schedule set in step S39.

In step S42, the control unit 13 determines whether the job for printing the inspection image for maintenance has been generated in step S36. When YES in step S36, the processing proceeds to step S43. When NO in step S36, the processing sequence is ended. In step S43, the control unit 13 reads the inspection image printed on the second sheet by a scanner of the inspection unit 5, and analyzes it to execute maintenance. The processing sequence is ended after the series of processes has ended.

Figure 6A:
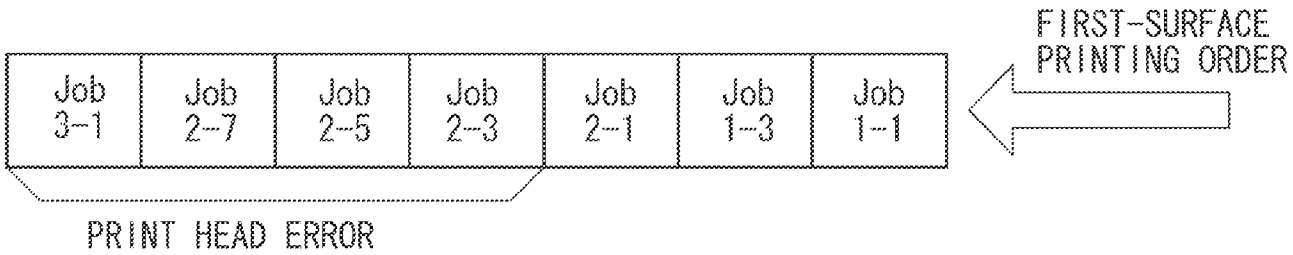
FIGS. 6A and 6B are explanatory conceptual diagrams illustrating printing schedule re-setting according to the second exemplary embodiment.
Figure 6B:
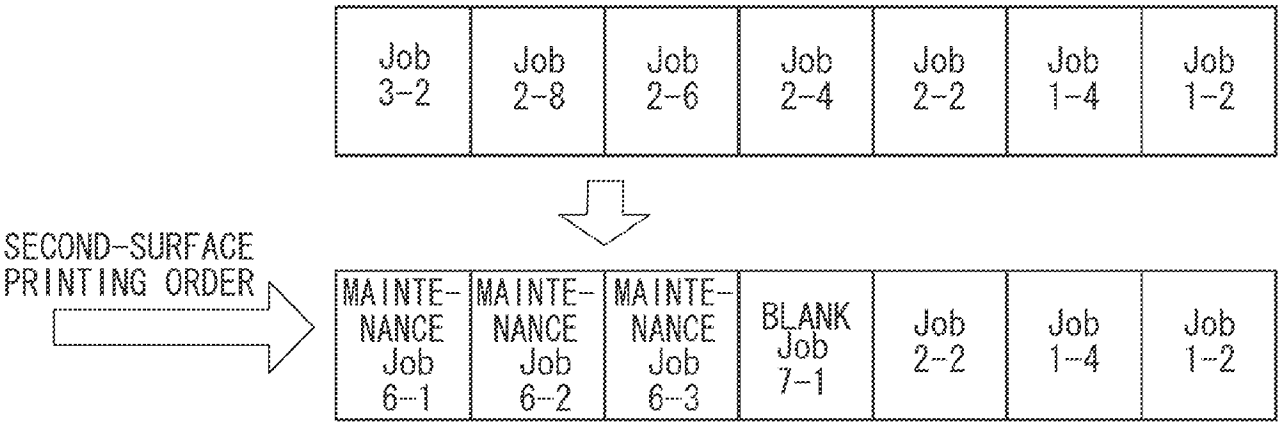

FIGS. 6A and 6B are explanatory conceptual diagrams illustrating printing schedule re-setting in step S39. FIG. 6A is a conceptual diagram of a first surface printing schedule illustrating a printing order of a plurality of images during first surface printing. In the first surface printing, the images are printed in an arrow order of pages Job1-1 to Job3-1. After printing of the last image of page Job3-5, the sheet is cut behind the last image, and all the printed pages are taken up at the reversing unit 9. In this example, the printing unit 4 is in a normal state from page Job1-1 to page Job2-1, so that normal images are printed. A failure occurs at the printing unit 4 for the image of page Job2-3, and accordingly the images of page Job2-3 to page Job3-1 are not normal.

FIG. 6B is a conceptual diagram of a second surface printing schedule illustrating a printing order of a plurality of images during second surface printing. An upper row illustrated in FIG. 6B is a preset printing schedule. On the second surface of the sheet, even-number pages Job1-2 to Job3-2 are arranged in order. A lower row illustrated in FIG. 6B is a printing schedule as a result of the re-setting in step S39. Pages Job1-2 to Job 2-2 of the back surface side corresponding to the three pages Job1-1 to Job2-1 normally printed on the first surface are printed as scheduled. On the other hand, pages Job2-4 to Job3-2 of the back surface side corresponding to the four pages Job2-3 to Job3-1 not normally printed on the first surface due to an abnormality of the printing unit 4 are canceled.

The canceled position is replaced by an inspection image for maintenance, a proof image or a blank image. In this example, the positions are replaced by three pages of maintenance Job6-1 to Job6-3 for printing inspection images, and one page of blank job7-1 for printing a blank image. Even when there is a defective image on the sheet back surface (second surface), the inspection image has no problem in inspection. These images are printed on another sheet in an arrow order to be inspected. The back surface side of the three pages Job1-1 to Job2-1 normally printed on the first surface can also be canceled to be replaced by the inspection image for maintenance, the proof image, or the blank image.

According to the second exemplary embodiment, when determining that the printing unit is not normal during the printing on the first surface in the duplex printing mode, the control unit executes processing for maintenance of the printing unit by using the second surface of the first-surface printed sheet. On the second surface, the control unit executes processing for maintenance by using a back face of an image not normal among the plurality of images printed on the first surface. Thus, maintenance of the printing unit can be carried out while reducing a wasteful sheet consumption. There is no operation to supply another sheet for maintenance again. Thus, a decrease of total printing throughput can be reduced.

Figure 7:
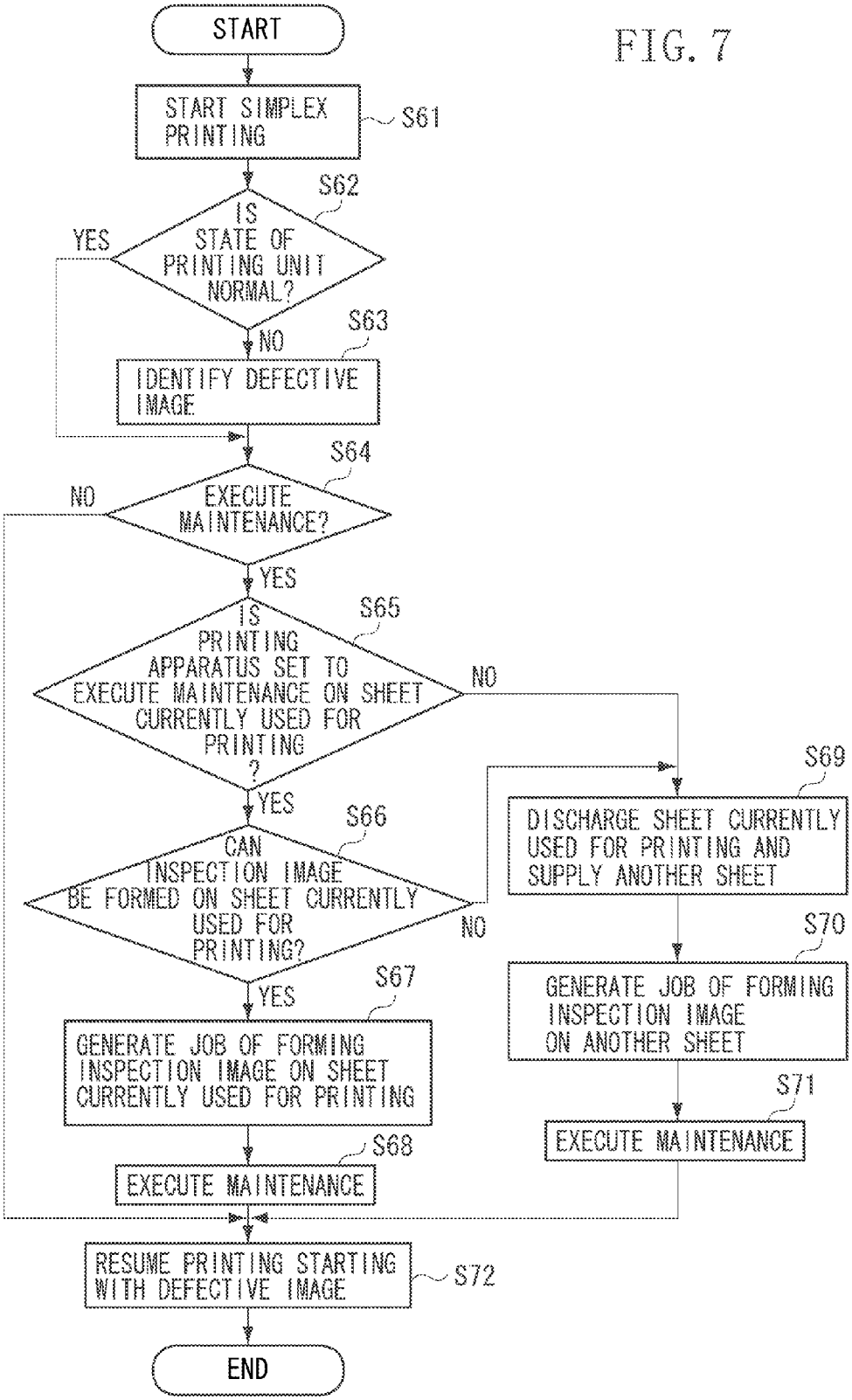
FIG. 7 is a flowchart illustrating a processing sequence according to a third exemplary embodiment of the present invention.

A third exemplary embodiment of the present invention is directed to an operation in the simplex printing mode while the first and second exemplary embodiments are directed to operations in the duplex printing mode. FIG. 7 is a flowchart illustrating a processing sequence according to the third exemplary embodiment.

An order of printing images on a sheet in the simplex printing mode is preset as a printing schedule. In step S61, the control unit 13 starts printing on one surface of the sheet according to the printing schedule. In step S62, the control unit 13 determines whether a state of the printing unit 4 is normal during printing. When determination is YES in step S62, the processing proceeds to step S64. When NO in step S62, the processing proceeds to step S63.

In step S63, the control unit 13 identifies and stores images estimated to be defective in printing after the state of the printing unit 4 has become abnormal.

In step S64, the control unit 13 determines whether to execute maintenance of the printing unit 4. Determination is YES when the control unit 13 determines that the printing unit 4 is not normal (NO in step S62). Determination is NO when the printing unit 4 is determined to be normal (YES in step S62). However, when the preset printing schedule includes planned maintenance, determination is YES even if no failure of the printing unit 4 is detected. The processing proceeds to step S65 when YES in step S64, and to step S72 when NO in step S64.

In step S65, the control unit 13 determines whether the printing apparatus has been set to execute processing for maintenance by using a currently printed sheet. The processing proceeds to step S66 when YES in step S65, and to step S69 when NO in step S65.

In step S66, the control unit 13 determines whether an inspection image can be printed on the currently printed sheet. The processing proceeds to step S67 when YES in step S66, and to step S69 when NO in step S66.

In step S67, the control unit 13 generates a job for printing the inspection image for maintenance on the currently printed sheet. The maintenance job is added to form an inspection image after the printed image.

In step S68, the control unit 13 executes the processing for maintenance of the printing unit 4. The control unit 13 prints the inspection image for maintenance on a supplied sheet by a print head. The control unit 13 then reads the printed inspection image by a scanner of the inspection unit 5 to analyze it. Based on a result of the analysis, the control unit 13 finely adjusts control of ink discharge timing or a sheet conveying speed. Alternatively, to solve a nozzle clogging problem, the control unit 13 preliminarily discharges ink to the sheet from the print head to execute head maintenance. When the head maintenance has ended, the processing proceeds to step S72.

In step S69, the control unit 13 cuts the currently printed sheet after the last printed image. The control unit 13 discharges, of the two cut sheets, a sheet of the downstream side from the printing unit 4, and returns a sheet of the upstream side to the sheet supply unit 1. The control unit 13 then supplies another sheet to the printing unit 4. The control unit 13 can employ some forms for supplying another sheet: a form of supplying the sheet again from the same rewound roll or a new sheet from another roll, or a form where, after cutting of the sheet at the last printing, a part of the sheet on the upstream side is left in a path without being completely returned to the sheet supply unit 1, and the same sheet is directly supplied. In other words, any form can be employed as long as a sheet different from the printed sheet is used for maintenance of the printing unit 4.

In step S70, the control unit 13 generates a job for forming an inspection image for maintenance on another sheet supplied in step S69. The control unit 13 sets a new maintenance job to form an inspection image on the sheet different from the printed sheet.

In step S71, the control unit 13 executes processing for maintenance of the printing unit 4, which is specifically similar to step S68. When the maintenance has ended, the processing proceeds to step S72.

In step S72, the control unit 13 resumes printing starting with a defective image. When passed through step S68, the control unit 13 resumes printing after the inspection image on the same sheet. When passed through step S71, the control unit 13 resumes printing after the inspection image on the maintenance sheet. The printing unit 4 has been set in a good state through the maintenance, and hence a normal image can be printed. After all the scheduled images have been printed, the processing sequence is ended.

According to the third exemplary embodiment, when determining that the printing unit is not normal during printing in the one-side printing mode, the control unit 13 executes processing for maintenance of the printing unit by using the sheet different from the printed sheet. This is effective when a used sheet is expensive. Executing maintenance by supplying another more inexpensive sheet rather than forming an inspection image on a currently printed expensive sheet enables a reduction of printing costs. According to the third exemplary embodiment, processing using the same sheet or processing using another sheet is selected to be set. In the case of supplying another sheet, a time is required for replacement of sheets. Thus, when printing throughput has priority, a decrease of printing throughput can be reduced by executing maintenance by using the same sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A printing control apparatus comprising:

a printing unit;

a printing control unit configured to cause the printing unit to sequentially print a plurality of images on a first surface of a sheet and to cause the printing unit to sequentially print a plurality of images on a second surface of the sheet that is a reverse side of the first surface, after the printing of the plurality of images on the first surface is performed;

a determining unit configured to determine whether a state of the printing unit is not normal; and a maintenance processing unit configured to execute maintenance processing of the printing unit by performing maintenance printing on a sheet, in a case where a state of the printing unit is determined as not normal, wherein, in a case where the determining unit determines that a state of the printing unit is not normal while the printing unit prints images on the first surface of the sheet, the printing control unit supplies another sheet other than the sheet on which images are printed on the first surface and the maintenance processing unit executes maintenance processing on said another sheet being supplied, and the printing control unit supplies the sheet on which images are printed on the first surface after the maintenance processing is executed, and prints images on the second surface corresponding to images which are normally printed within the plurality of images printed on the first surface of the sheet.

2. The printing control apparatus according to claim 1, wherein, in the case where the determining unit determines that a state of the printing unit is not normal while the printing unit prints images on the first surface of the sheet, the maintenance processing is executed by supplying the another sheet other than the sheet on which images are printed on the first surface by interrupting printing of subsequent images to be printed on the first surface of the sheet, and after executing the maintenance processing, the sheet on which images are printed on the first surface is supplied and images on the second surface corresponding to the images which are normally printed within a plurality of images printed on the first surface, are printed on the second surface of the sheet.

3. The printing control apparatus according to claim 1, wherein, in the case where the determining unit determines that a state of the printing unit is not normal while the printing unit print images on the first surface of the sheet, the maintenance processing is executed by supplying the another sheet other than the sheet on which images are printed on the first surface by holding the sheet on which images are printed on the first surface with a holding unit, and after executing the maintenance processing, the sheet on which images are printed on the first surface is supplied from the holding unit.

4. The printing control apparatus according to claim 3, wherein, in the case where the determining unit determines that a state of the printing unit is not normal while the printing prints images on the first surface of the sheet, the sheet on which images are printed on the first surface is cut, and by holding the sheet being cut, the maintenance processing is executed by supplying the another sheet other than the sheet on which images are printed on the first surface, and after performing the maintenance processing, the sheet on which images are printed on the first surface is supplied from the holding unit.

5. The printing control apparatus according to claim 1, wherein, in a case where the printing control unit controls the printing unit to perform a printing on a second surface of the sheet of which images are printed on a first surface, the printing unit prints images from a back-end side of the first surface of the sheet.

6. The printing control apparatus according to claim 1, wherein an image for proof inspection is printed after executing the maintenance processing.

7. The printing control apparatus according to claim 6, wherein the image for proof inspection is printed in an area that is a second surface of a sheet of which images are printed on a first surface and corresponding to images which are not normal within a plurality of images printed on a first surface.

8. The printing control apparatus according to claim 1, wherein, in a case where the determining unit determines that a state of the printing unit is not normal when performing a printing on a second surface of the sheet of which images are printed on the first surface, the maintenance processing is executed by supplying another sheet other than the sheet on which images are printed, or the maintenance processing is executed by using an area where the second surface of the sheet on which the images are printed continues.

9. The printing control apparatus according to claim 1, wherein the determining unit determines whether a state of the printing is normal by printing an inspection pattern between images.

10. The printing control apparatus according to claim 1, wherein the determining unit determines that a state of the printing unit is not normal in a case where defective discharge of ink from an ink jet print head included in the printing unit is detected, and wherein an inspection image for inspecting is printed on a sheet from the print head or a preliminary discharge is performed on a sheet.

11. The printing control apparatus according to claim 10, wherein in the maintenance processing, the state of the print head is inspected by reading the inspection image with a scanner and by analyzing the inspection image.

12. A printing control method comprising:

sequentially printing with a printing unit a plurality of images on a first surface of a sheet;

sequentially printing a plurality of images on a second surface of the sheet that is a reverse side of the first surface, after printing the plurality of images on the first surface;

determining whether a state of the printing unit is not normal; and performing maintenance processing of the printing unit by executing maintenance printing on a sheet, in a case where a state of the printing unit is determined as not normal, wherein, in a case where a state of the printing unit is determined as not normal while printing images on the first surface of the sheet, the maintenance processing is executed by supplying another sheet other than the sheet on which images are printed on the first surface is supplied, and after the maintenance processing is executed, the sheet on which images are printed on the first surface is supplied, and images on the second surface corresponding to images printed normally within a plurality of images printed on the first surface are printed.

* * * * *